US006241585B1

(12) United States Patent
White

(10) Patent No.: US 6,241,585 B1
(45) Date of Patent: Jun. 5, 2001

(54) APPARATUS AND METHOD FOR CHEMICAL MECHANICAL POLISHING

(75) Inventor: John M. White, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/344,222

(22) Filed: Jun. 25, 1999

(51) Int. Cl.[7] ..... B24B 1/00

(52) U.S. Cl. ..... 451/41; 451/285; 451/288; 451/289; 451/291; 451/292; 451/401

(58) Field of Search ..... 451/41, 285, 288, 451/289, 291, 292, 401

(56) References Cited

U.S. PATENT DOCUMENTS

| | | | | |
|---|---|---|---|---|
| 2,963,830 | * | 12/1960 | Hook | 451/291 |
| 3,492,762 | * | 2/1970 | Heinrich | 451/291 |
| 4,343,112 | * | 8/1982 | Jarrett | 451/291 |
| 5,558,568 | | 9/1996 | Talieh et al. . | |
| 5,575,707 | | 11/1996 | Talieh et al. . | |
| 5,593,344 | | 1/1997 | Weldon et al. . | |
| 5,692,947 | | 12/1997 | Talieh et al. . | |
| 5,800,248 | * | 9/1998 | Pant et al. | 451/41 |
| 5,961,372 | * | 10/1999 | Shendon | 451/41 |

FOREIGN PATENT DOCUMENTS

WO 96/36459 11/1996 (WO) .

* cited by examiner

*Primary Examiner*—Joseph J. Hall, III
*Assistant Examiner*—Shantese McDonald
(74) *Attorney, Agent, or Firm*—Fish & Richardson

(57) ABSTRACT

A chemical mechanical polishing apparatus includes a rotatable carousel and multiple carrier head assemblies coupled to the carousel. Each carrier head assembly includes multiple carrier heads each of which can hold a single substrate. The apparatus includes multiple substrate processing stations separated from one another in substantially equal angular intervals. The carrier head assemblies can be positioned in angular alignment with the stations and can be rotated from one station to another station. At least one polishing station includes a fixed abrasive sheet and a fluid bearing surface that provides an upward pressure against the lower surface of the polishing sheet. The carrier head assembly is positioned so that the substrates are in angular alignment with the fluid bearing disposed below the polishing sheet, and the substrates are brought into contact with the polishing sheet. The carrier head assembly and the fluid bearing then are rotated at substantially the same speed and in angular alignment while the substrates are held in contact with the polishing sheet to polish the substrates.

25 Claims, 9 Drawing Sheets

APPARATUS AND METHOD FOR CHEMICAL MECHANICAL POLISHING

BACKGROUND

The present invention relates generally to chemical mechanical polishing of substrates.

An integrated circuit is typically formed by the sequential deposition of conducting, semiconducting or insulating layers on a silicon wafer. One fabrication step involves depositing a filler layer over a patterned stop layer, and planarizing the filler layer until the stop layer is exposed. For example, trenches or holes in an insulating layer may be filled with a conductive layer. After planarization, the portions of the conductive layer remaining between the raised pattern of the insulating layer form vias, plugs and lines that provide conductive paths between thin film circuits on the substrate.

Chemical mechanical polishing (CMP) is one accepted method of planarization. CMP typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, in other words, pressure, on the substrate to push it against the polishing pad. A polishing slurry, including at least one chemically-reactive agent, and abrasive particles if a standard pad is used, is supplied to the surface of the polishing pad.

An effective CMP process provides not only a high polishing rate, but also a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer, which in turn sets the maximum throughput of the CMP apparatus.

During CMP operations, the polishing pad needs to be replaced periodically. For a fixed-abrasive pad, the substrate wears away the containment media to expose the embedded abrasive particles. Thus, the fixed-abrasive pad is gradually consumed by the polishing process and, after a number of polishing runs (e.g., as few as about 40–50 and as many as several hundred), the fixed-abrasive pad needs to be replaced. For a standard pad, the substrate thermally and mechanically damages the polishing pad and causes the pad's surface to become smoother and less abrasive. Therefore, most standard pads must be periodically conditioned to restore a roughened texture to their surface. After a number of conditioning operations (e.g., as few as several hundred and as many as several thousand), the conditioning process consumes the pad or the pad is unable to be properly conditioned. The pad must then be replaced. An advantage of fixed-abrasive polishing pads is that they may not need to be conditioned.

One problem encountered in the CMP process is the difficulty in replacing the polishing pad. The polishing pad may be attached to the platen surface with an adhesive. Significant physical effort is often required to peel the polishing pad away from the platen surface. The adhesive then must be removed from the platen surface by scraping and washing with a solvent. A new polishing pad can then be adhesively attached to the clean surface of the platen. While this is happening, the platen is not available for the polishing of substrates, resulting in a decrease in polishing throughput. This problem is even more acute for fixed-abrasive pads, which need to be replaced more often than standard polishing pads. Thus, although the fixed-abrasive pads may not need to be conditioned, the use of fixed-abrasive pads in a CMP apparatus can result in a higher cost of operation.

Another problem that can arise when using a CMP process is difficulty in achieving a high throughput for the polishing process. Typically, substrates must be loaded and unloaded into the CMP apparatus. In addition to polishing the substrates using a fixed-abrasive pad, it is sometimes desirable to buff the substrates as well using a standard pas. The polishing, buffing, and loading/unloading steps are often performed sequentially using an architecture that performs only a single one of the steps at a time. It would, therefore, be desirable to modify the architecture of existing CMP apparatus to improve the overall throughput.

SUMMARY

In general, according to one aspect, a chemical mechanical polishing apparatus includes a rotatable carousel and multiple carrier head assemblies coupled to the carousel. Each carrier head assembly includes multiple carrier heads each of which can hold a substrate. Each carrier head assembly also includes a motor-driven system for causing the carrier head assembly to rotate about its center axis.

The CMP apparatus also can include multiple substrate processing stations. The processing stations can be separated from one another in substantially equal angular intervals, and the carrier head assemblies can be positioned in angular alignment with the stations. The carousel can be rotated to move each carrier head assembly from one station to another station.

According to another aspect, a polishing station of a CMP apparatus includes a substantially fixed polishing sheet and a fluid bearing surface that provides an upward pressure against the lower surface of the polishing sheet. In one implementation, the station includes a fixed abrasive polishing sheet and a rotatable plate disposed below an exposed portion of the polishing sheet. An upper surface of the plate is positioned near a lower surface of the polishing sheet. The rotatable plate includes a pattern of holes in its upper surface through which a fluid can flow to provide an upward pressure against the lower surface of the polishing sheet.

In some implementations, the polishing sheet includes a thin coated, micro-replicated, fixed-abrasive polishing pad having relatively high bulk compressibility and low bending stiffness.

In some implementations, the CMP apparatus also includes a source for providing fluid to the holes in the rotatable plate and a computer-controlled valve for controlling the flow of fluid from the source to the pattern of holes in the rotatable plate. The pattern of holes in the upper surface of the rotatable plate can include an area whose size corresponds to a substrate to be polished by the polishing sheet. In some cases, the pattern of holes in the upper surface of the rotatable plate includes multiple areas of vertical holes. Each area of holes can have a size that corresponds to a substrate to be polished by the polishing sheet. Furthermore, the flow of fluid to each of the areas of holes can be controlled independently. A motor can be coupled to the rotatable plate for causing the plate to rotate during polishing.

According to yet another aspect, a CMP apparatus includes a carrier head assembly with multiple carrier heads each of which can hold a substrate, a shaft about which the carrier head assembly can be rotated, and a motor-driven pulley system for causing the carrier head assembly to rotate about the shaft. The apparatus can further include a system of gears coupled to the carrier heads for causing each of the carrier heads to move in a circular path substantially without rotating with respect to a fixed point as the carrier head assembly is rotated about the shaft. In one implementation, the system of gears includes a central gear surrounding the shaft, idler gears coupled to the central gear, and outer gears. Each outer gear is coupled to one of the idler gears and a respective one of the carrier heads.

A rotatable fluid coupling can be positioned about the shaft. The apparatus can include multiple channels having one end coupled to the fluid coupling and a second end rotarily coupled to a respective one of the carrier heads. The flow of fluid can be used to provide a downward pressure on substrates held by the carrier heads. In some implementations, the pressure on a substrate held by each carrier head can be controlled independently. Polishing of a substrate held by a first one of the carrier heads can be stopped while polishing of a substrate held by a second one of the carrier heads is continued.

According to a further aspect, a CMP apparatus includes a polishing station which has a substantially fixed polishing sheet and a rotatable plate disposed below an exposed portion of the polishing sheet such that an upper surface of the plate is positioned near a lower surface of the polishing sheet. The plate includes multiple areas of holes in its upper surface through which a fluid can flow to provide an upward pressure against the lower surface of the polishing sheet. Each area of holes has a size that corresponds to a substrate to be polished by the polishing sheet. The apparatus also includes a rotatable carrier head assembly with multiple carrier heads each of which can hold a substrate. The carrier head assembly can be positioned to bring the substrates into contact with an upper surface of the polishing sheet. Also, the rotatable plate and the carrier head assembly can be rotated at substantially the same speed and in angular alignment when the substrates are held in contact with the polishing sheet so that the substrates remain positioned directly above the areas of holes in the plate during polishing.

The invention also features methods of polishing one or more substrates held by a carrier head assembly. According to one aspect, the method includes positioning the carrier head assembly so that the substrates are in angular alignment with a fluid bearing disposed below a substantially fixed polishing sheet. The carrier head assembly is positioned to bring the substrates into contact with the polishing sheet. The carrier head assembly and the fluid bearing are rotated at substantially the same speed and in angular alignment while the substrates are held in contact with the polishing sheet to polish the substrates.

In some implementations, the method further includes independently controlling, during polishing, a downward pressure with which each substrate is pressed against the polishing sheet. Also, a first one of the substrates can be lifted out of contact with the polishing sheet while a second one of the substrates continues to be polished by the polishing sheet. An upward pressure can be provided to counteract a downward pressure exerted on the substrates. The amount of upward pressure can be controlled independently for each of the substrates. Preferably, the substrates move in a circular path substantially without rotating with respect to the polishing sheet as they are polished.

Various implementations include one or more of the following advantages. The overall throughput of the CMP apparatus can be increased because the architecture of the system allows multiple processes to be performed to a particular substrate without unloading the substrate from the CMP apparatus. Other than the time it takes to move the carrier head assemblies from between stations, most of the time can be used to polish, buff or load/unload the substrates. Therefore, the throughput can be increased further. Additionally, each carrier head assembly can simultaneously hold multiple substrates. For example, multiple substrates can be polished using a fixed abrasive sheet, while other substrates are buffed and yet other substrates are loaded or unloaded. The various processing steps can be accomplished in a single CMP apparatus, thereby increasing the overall throughput of the fabrication process.

Additional advantages can be obtained as a result of using a substantially fixed web-type abrasive sheet in conjunction with a fluid bearing. Web-type abrasive polishing sheets are generally thin and incompressible relative to other polishing pad materials and have a low bending stiffness. Therefore, it is possible to use the web-type abrasive sheet either alone or in conjunction with a sub-pad to achieve a desired stiffness and compressibility. In particular, a web-type of abrasive sheet and a sub-pad can be selected to modify the overall bending modulus and, therefore, provide improved compliance with the surface of the substrate.

Although an unreinforced web-type abrasive sheet does not generally provide a particularly good material against which to press solid, mechanical, moveable bearing surface, the fluid bearing can provide a comparatively gentle and substantially uniform bearing force against the downward pressure of the carrier heads. Therefore, the fluid bearing allows the CMP apparatus to take advantage of the beneficial features of a thin webtype of abrasive sheet. Rotating the fluid bearing at the same speed and in angular alignment with the carrier heads while the substrates are held in contact with the abrasive sheet helps assure that the substrates remain positioned directly above the fluid bearing surface of the plate during polishing. The quality of the polished substrates can, therefore, be improved.

Use of the fluid bearing also makes possible a wide selection of materials as the web-type abrasive sheet and/or the sub-pad because the fluid bearing is not likely to damage the material it is supporting. Therefore, the optimum bending stiffness ad compressibility required to achieve a highly uniform polish for the finished substrates can be selected with less concern for the durability or other mechanical properties of the fixed abrasive sheet or the sub-pad. The sub-pad can be used to optimize local and global polishing uniformity across the substrate.

Other features and advantages will be apparent from the detailed description, the drawings and the claims.

DETAILED DESCRIPTION

Figure 1:
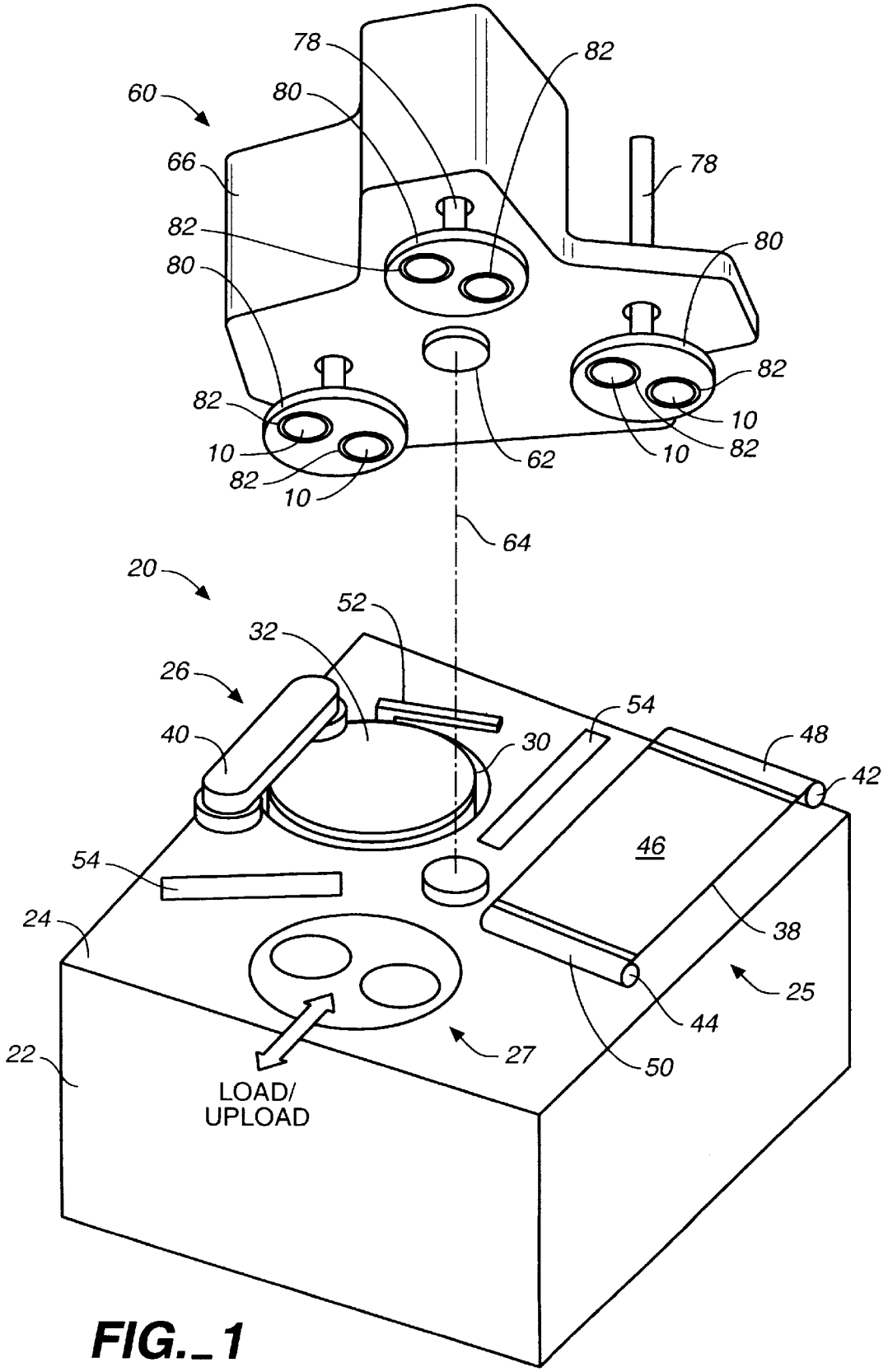
FIG. 1 is a schematic exploded perspective view of a chemical mechanical polishing apparatus according to the invention.

As shown in FIG. 1, one or more substrates 10 can be polished by a chemical mechanical polishing apparatus 20. The polishing apparatus 20 includes a machine base 22 with a table top 24 that supports a series of polishing stations, including a first polishing station 25, a second polishing station 26, and a transfer station 27. The stations 25, 26, 27 are separated from one another by substantially equal angular intervals.

The transfer station 27 serves multiple functions, including receiving one or two substrates 10 from a loading apparatus (not shown), washing the substrates, loading the substrates into carrier head assemblies 80, receiving the substrates from the carrier head assemblies, washing the substrates again, and finally, transferring the substrates back to the loading apparatus.

The first polishing station 25 includes a polishing cartridge 38 detachably secured to the top of the table 24. The polishing cartridge 38 includes a feed roller 42, a take-up roller 44, and a generally linear sheet 46 of a polishing pad material. An unused or fresh portion 48 of the polishing sheet 46 is wrapped around the feed roller 42, and a used portion 50 of the polishing sheet is wrapped around the take-up roller 44. A rectangular exposed portion of the polishing sheet 46 is used to polish substrates and extends between the used and unused portions 48, 50.

The polishing sheet 46 is preferably a web-type fixed-abrasive pad and is linearly advanceable between the feed roller 42 and the take-up roller 44. Thus, the sheet can be a thin coated, micro-replicated, fixed-abrasive polishing medium which has relatively high bulk compressibility and low bending stiffness. For example, the fixed-abrasive polishing sheet 46 can include an upper layer and a lower layer. The upper layer is an abrasive composite layer composed of abrasive grains held or embedded in a binder material. The abrasive grains may have a particle size between about 0.1 and 1500 microns. Examples of such grains include silicon oxide, fused aluminum oxide, ceramic aluminum oxide, green silicon carbide, silicon carbide, chromium, alumina zirconium, diamond, iron oxide, cerium, cubic boron nitride, garnet and combinations thereof. The binder material may be derived from a precursor which includes an organic polymerizable resin which is cured to form the binder material. Examples of such resins include phenolic resins, urea-formaldehyde resins, melamine formaldehyde resins, acrylated urethanes, acrylated epoxies, ethylenically unsaturated compounds, aminoplast derivatives having at least one pendant acrylate group, isocyanurate derivatives having at least one pendant acrylate group, vinyl ethers, epoxy resins, and combinations thereof. The lower layer is a backing layer composed of a material such as a polymeric film, paper, cloth, a metallic film or the like.

Additional details of the first polishing station 25 are described in greater detail below.

The polishing station 26 includes a standard polishing pad 32 adhesively attached to a circular platen 30. The polishing station 26 also can include a combined slurry/rinse arm 52 that projects over the associated polishing surface. The slurry/rinse arm 52 can include slurry supply tubes to provide a polishing liquid, slurry, or cleaning liquid to the surface of the polishing pad. Typically, sufficient liquid is provided to cover and wet the entire polishing pad. Each slurry/rinse arm can include several spray nozzles (not shown) to provide a high-pressure rinse at the end of each polishing and conditioning cycle. The polishing station 26 also can include an optional associated pad conditioner apparatus 40.

Optional cleaning stations 54 may be positioned between polishing stations 25, 26 and between the polishing stations 26 and the transfer station 27 to clean the substrates as they move between the stations.

Figure 7:
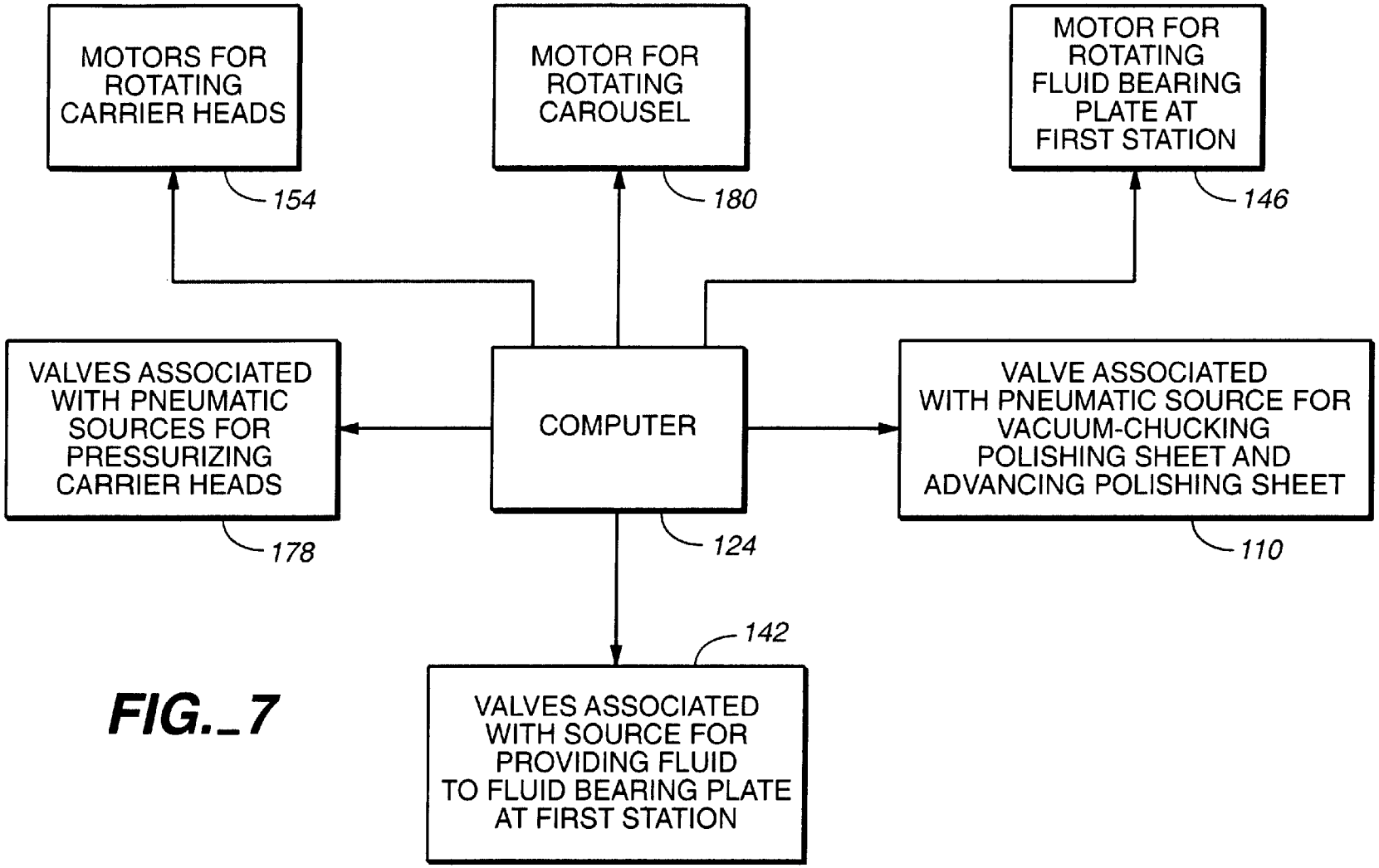
FIG. 7 is a block diagram illustrating components of the chemical mechanical polishing apparatus that control its overall operation.

A rotatable multi-head carousel 60 can be supported above the polishing stations by a center post 62 and is rotated about a carousel axis 64 by a motor 180 (FIG. 7). In the illustrated implementation, the carousel 60 can include three carrier head assemblies 80 mounted on a carousel support plate 66 at substantially equal angular intervals about the carousel axis 64. During operation of the system, one carrier head assembly receives and holds substrates, and polishes the substrates by pressing them against the polishing sheet 46 of the first station 25. Another one of the carrier head assemblies polishes substrates by pressing them against the polishing pad 32 of the second station 26. The third carrier head assembly receives substrates from and delivers substrates to the transfer station 27. The carousel 60 can be rotated to move the carrier head assemblies 80 between the stations.

In the illustrated embodiment, each carrier head assembly 80 includes two carrier heads 82. A respective rotation motor 154 (FIG. 5A) is provided for each of the carrier head assemblies 80 so that each carrier head assembly independently can rotate about its own axis. The carrier head assembly motors 154, as well as the motor 180 that controls rotation of the carousel 60, are controlled by a general purpose programmable digital computer 124 (FIG. 7).

Providing each carrier head assembly 80 with multiple carrier heads 82 allows a large number of substrates 10 to be processed within a relatively short period of time. Furthermore, in the illustrated implementation, the carousel 60 needs only four driving motors to rotate the three carrier head assemblies 80 and to rotate the carousel 60. The illustrated CMP apparatus can process up to six substrates at one time.

Each carrier head 82 performs several mechanical functions. Generally, the carrier head holds a substrate 10 against the polishing surface, evenly distributes a downward pressure across the back surface of the substrate, transfers torque to the substrate, and ensures that the substrate does not slip out from beneath the carrier head during polishing operations. A retaining ring 72 (see FIG. 5A) is provided about the outer perimeter of each carrier head 82 to help hold the substrate 10 in place.

Figure 2:
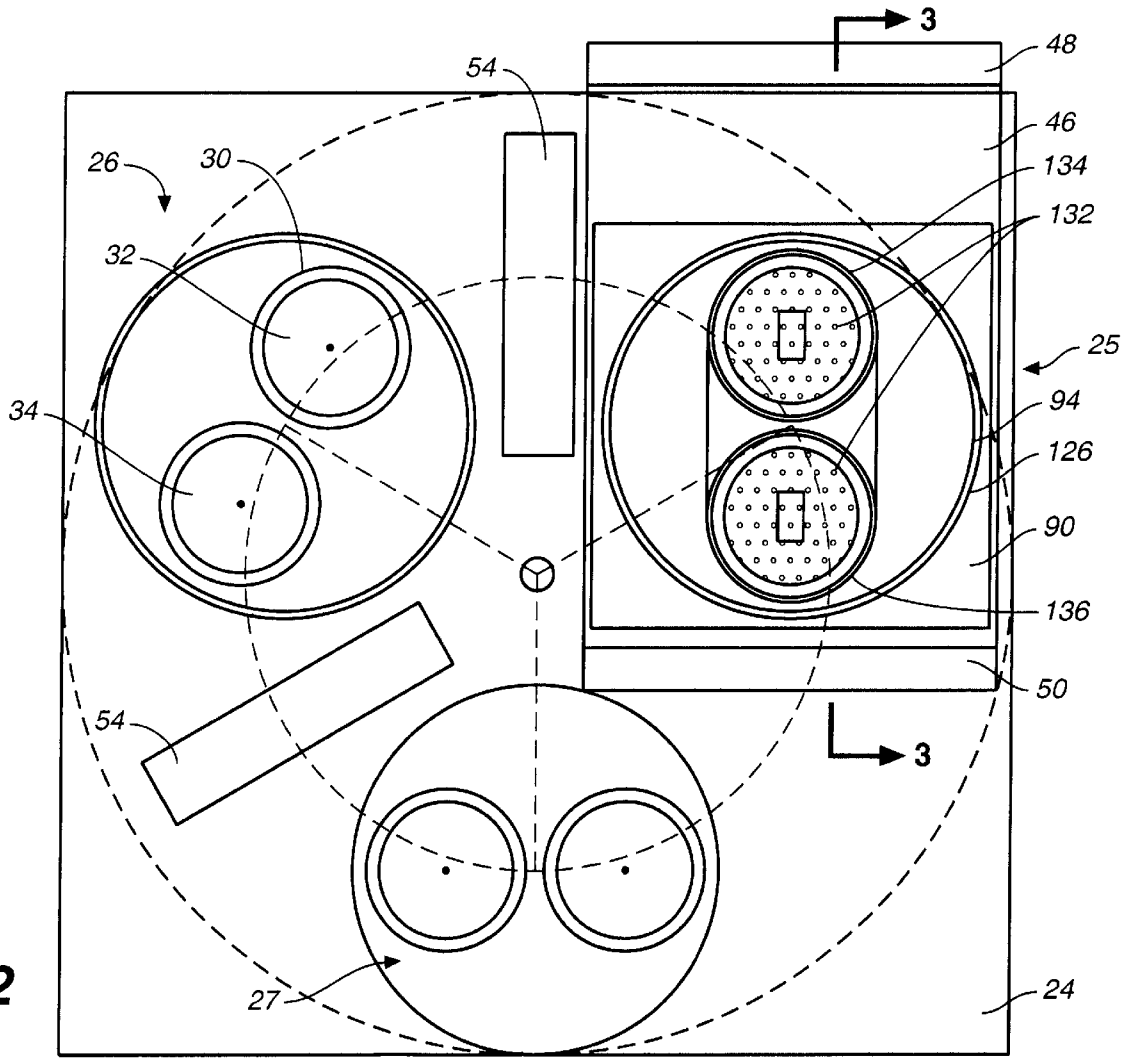
FIG. 2 is a plan view of the table top of the CMP apparatus of FIG. 1 according to the invention.
Figure 3:
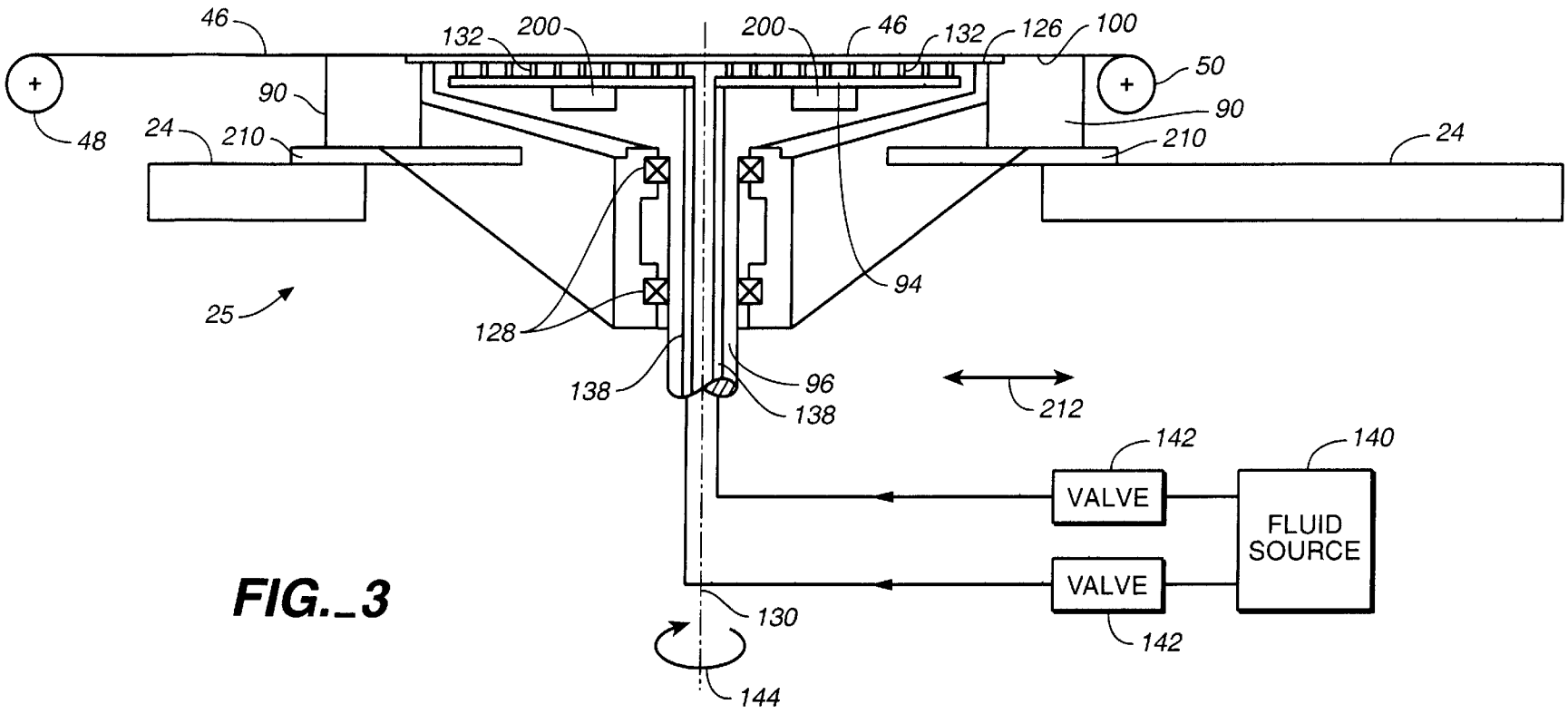
FIG. 3 is a partial side view of the polishing station taken along line 3—3 of FIG. 2.
Figure 4A:
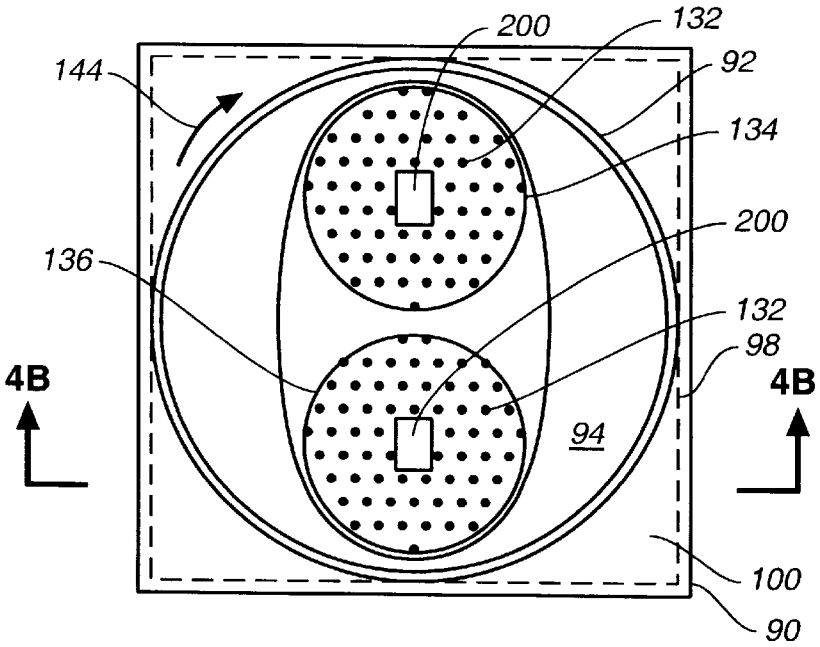
FIG. 4A is plan view illustrating additional details of a platen and fluid bearing at the polishing station of FIG. 3.
Figure 4B:
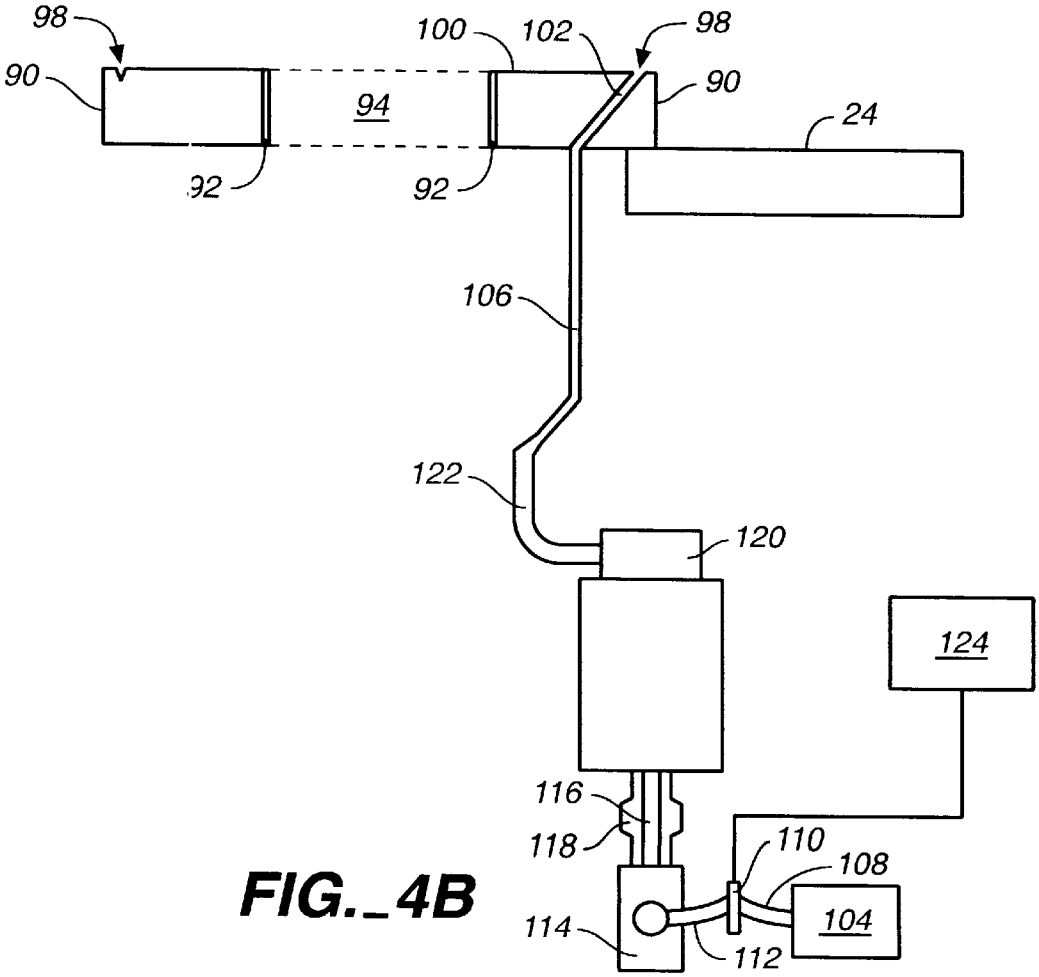
FIG. 4B is a cross-sectional view illustrating additional details of the polishing station of FIG. 3.

Further details of the polishing station 25 are illustrated in FIGS. 2, 3, 4A and 4B. A square or rectangular-shaped platen 90, supported by the table 24, has a circular hole surrounded by a seal, such as an O-ring 92 (FIG. 4A). One or more grooves 98, shown in phantom in FIGS. 4A and 4B, are formed in a top surface 100 of the platen 90. The groove 98 can be a generally-rectangular or other pattern that extends along the edges of the top surface 100. A passage 102 through the platen 100 connects the groove 98 to a vacuum source 104. When the passage 102 is evacuated, a portion of the polishing sheet 46 is vacuum-chucked to the top surface 100 of the platen 90. That helps ensure that lateral forces caused by friction between the substrate and the polishing sheet during polishing do not force the polishing sheet off the platen.

A pneumatic control line 106 connects the passage 102, and thus the groove 98, to the vacuum source 104. Multiple pneumatic lines 106 can be used to vacuum-chuck the polishing sheet 46 and to activate a polishing sheet advancement mechanism. A pump or source of pressurized gas, for example, can be used as the vacuum source 104. The vacuum source 104 is connected by a fluid line 108 to a computer controlled valve 110. The computer controlled valve 110 is connected by a second fluid line 112 to a rotary coupling 114. The rotary coupling 114 connects the vacuum source 104 to an axial passage 116 in a rotating shaft 118, and a coupling 120 connects the axial passage 116 to one end of a flexible pneumatic line 122. The other end of the flexible pneumatic line 122 is connected to the pneumatic line 106. The computer 124 is coupled to the valve 110 and controls whether the valve is open or closed.

As further shown in FIG. 3, a rotatable shaft 96 supports a plate 94 and extends through the central hole in the platen 90. Bearings 128 permit the shaft 96 to be rotated about its central axis 130. A motor 146 (FIG. 7), controlled by the computer 124, causes the rotation of the shaft 96. As the shaft 96 is rotated about its axis 130, the plate 94 also rotates, as indicated by the arrow 144 (FIGS. 3 and 4A). As explained in greater detail below, the plate 94 rotates during polishing of the substrates 10. However, the platen 90, which provides a vacuum to hold down the abrasive sheet 46 during polishing, remains stationary.

The rotatable plate 94 can be a flat, rigid metal plate which has a pattern of vertical holes 132 extending through it. The vertical holes 132 are located in two circular areas 134, 136 of the plate 94 and serve as a means for introducing a fluid underneath the abrasive sheet 46. The fluid serves as a fluid bearing. Each circular area 134, 136 is approximately the same size as a single substrate 10. If the retaining ring 72 in the carrier head 82 is designed to contact the polishing surface, then each circular area 134, 136 can be approximately the size of a single substrate 10 plus its retaining ring 72. The top surface of the plate 94 can be at substantially the same height or slightly lower than the top surface 100 of the platen 90 to allow a subpad 126 to be placed between the fluid bearing and the polishing sheet 46. The sub-pad 126, if used, can modify the effective compressibility of the abrasive sheet 46.

The shaft 96 includes one or more channels, such as hollow tubes 138, through which a fluid, such as air or water, can be provided to the fluid bearing plate 94. A separate channel 138 can be used to provide air flow to each of the areas 134, 136 of holes 132 in the plate 94. The computer 124 (FIG. 7) controls the positions of respective valves 142 to control the flow of a fluid, such as air or water, from a source 140 to the fluid bearing 94 via the channels 138. The amount of fluid flowing through each of the channels 138 can be controlled independently.

When substrates 10 are placed against the upper surface of the polishing sheet 46, they are positioned opposite the circular areas 134, 136 of holes 132 on the plate 94. During polishing, the pressure created by the flow of air through the holes 132 counteracts the downward pressure exerted on the substrates. A pattern of holes 132 can be provided so that the amount of upward pressure provided by the air flowing through the vertical holes 132 varies across the substrate 10. If desired, the pattern of holes 132 can be designed so that the effective area of the holes locally produces a nonuniform pressure profile across the face of the substrate 10. Additionally, the amount of fluid exiting each hole can be varied to produce a desired pressure distribution on the face of the substrate.

One or more in-situ monitors 200 are mounted below the plate 94 (see, e.g. FIG. 3). The monitors 200 use optical or other techniques to perform end-point or thickness monitoring and determine when polishing should be stopped with respect to the substrates 10. Preferably, a monitor 200 is mounted directly below the center of each area 134, 136 of holes 132 so that each substrate 10 held by one of the carrier heads 82 is positioned directly above a monitor during polishing (see, e.g., FIG. 4A). Alternatively, one or more monitors can be mounted in a fixed position so that the substrates pass directly above the monitor(s) during polishing. To allow optical signals, for example, to be reflected off the face of a substrate 10 and detected by one of the monitors 200, windows (not shown) can be provided in the plate 94. The abrasive sheet 46, as well as the sub-pad 126, can be provided with transparent regions to allow the end-point or thickness monitoring to be performed.

Figure 5A:
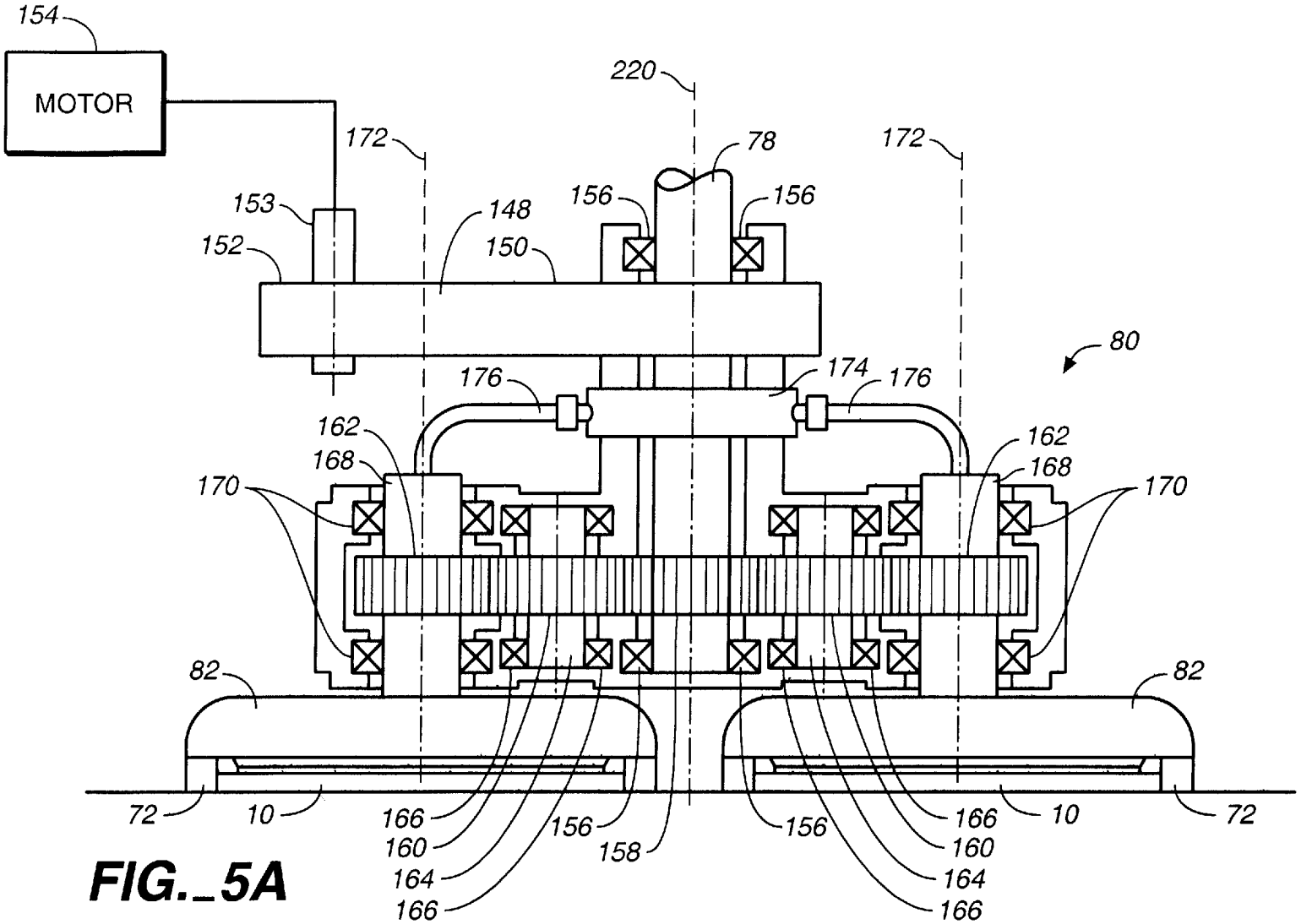
FIG. 5A is a cross-section of a carrier head assembly according to the invention.
Figure 5B:
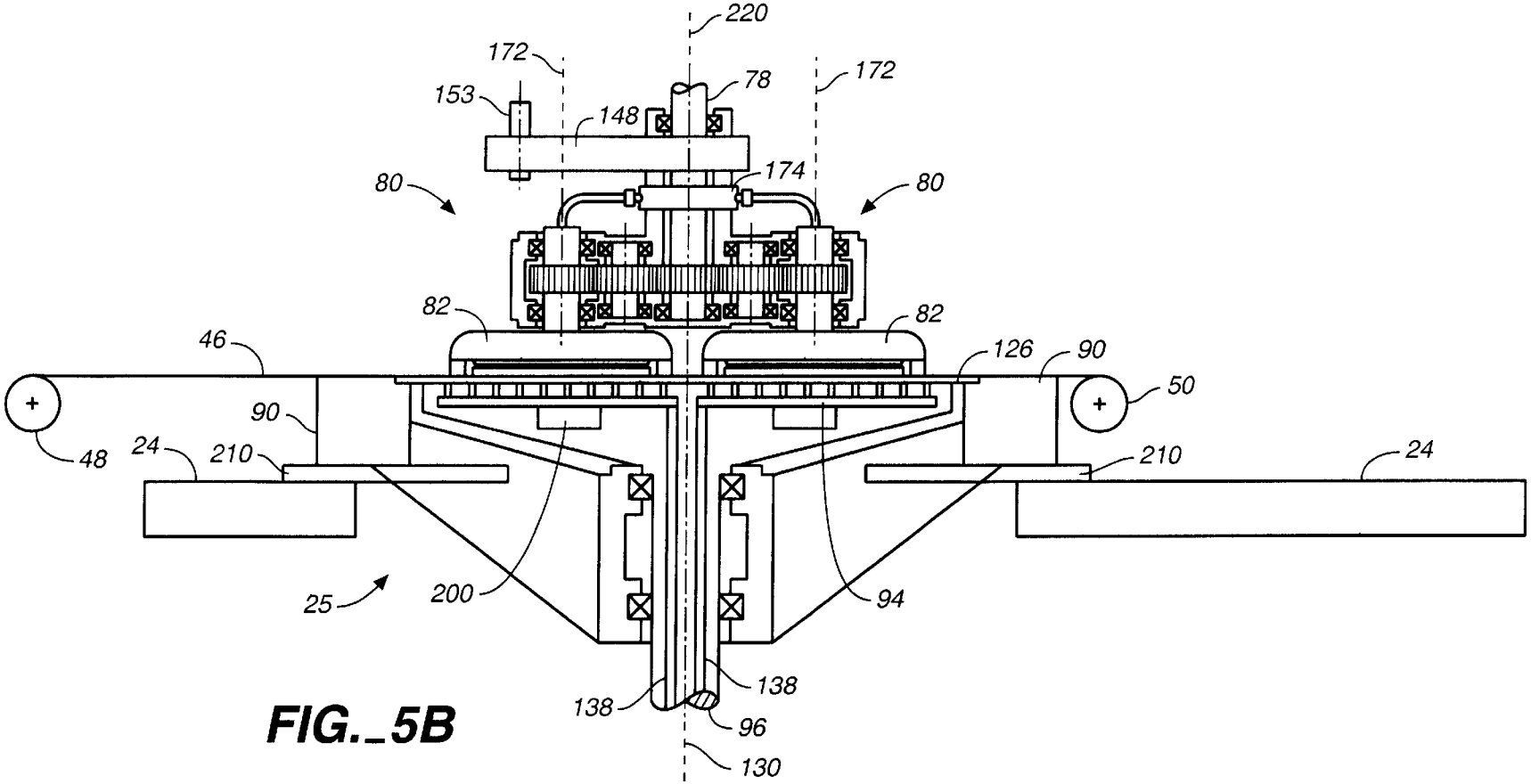
FIG. 5B is a cross-section of the carrier head assembly of FIG. 4A positioned at the polishing station of FIG. 3.

Each of the three carrier head assemblies 80 is substantially the same. As shown in FIG. 5A, a stationary shaft 78, which can be mounted to a fixed cross-beam, has a central axis 220 that extends vertically through the carrier head assembly 80. Other mounting techniques also can be used. When a carrier head assembly 80 is positioned for polishing the substrates 10 at the first station 25, the axes 220 and 130 are aligned (FIG. 5B). A first pulley 150 is provided about the central shaft 78, and a second pulley 152 is provided about a rotatable shaft 153. A belt 148 is provided around the pulleys 150, 152. The second pulley 152 can be rotated by one of the motors 154 which, as shown in FIG. 7, is controlled by the computer 124. The carrier head assembly 80 includes bearings 156 which allow the carrier head assembly to rotate about the stationary shaft 78 when the motor 154 is operating. When the motor 154 causes the shaft 153 to rotate, the pair of pulleys 150, 152 and the belt 148 coordinate to rotate the entire carrier head assembly 80 about the stationary shaft 78.

As further illustrated in FIGS. 5A and 5B, the carrier head assembly 80 includes several gears, including a central stationary gear 158 surrounding the stationary shaft 78, a pair of idler gears 160, and two outer gears 162. A respective vertical shaft 164 and bearings 166 are associated with each of the idler gears 160 to allow the idler gears to rotate. Similarly, a respective hollow shaft 168 and bearings 170 are associated with each of the outer gears 162 so that they can rotate as well. Each hollow shaft 168 is connected at its lower end to a respective one of the carrier heads 82 in the assembly 80.

Figure 6A:
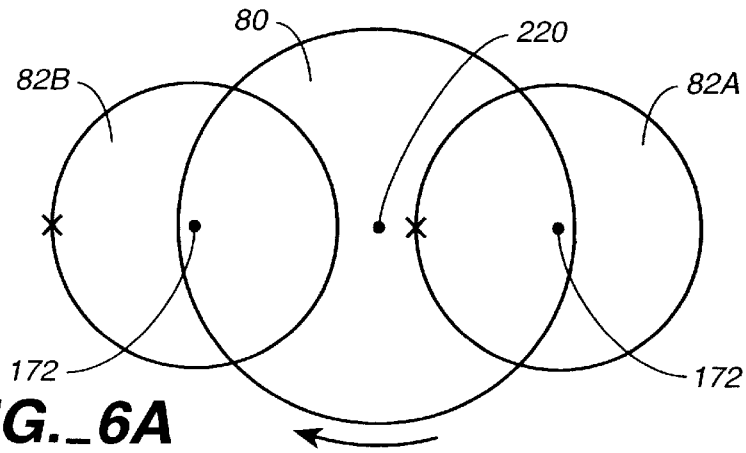
FIGS. 6A, 6B and 6C illustrate movement of the carrier heads in a circular path substantially without rotating with respect to a fixed point as the carrier head assembly is rotated.
Figure 6B:
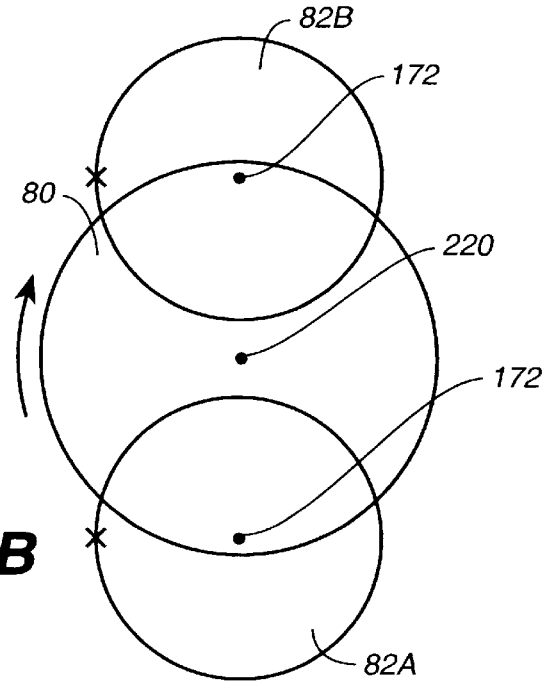
Figure 6C:
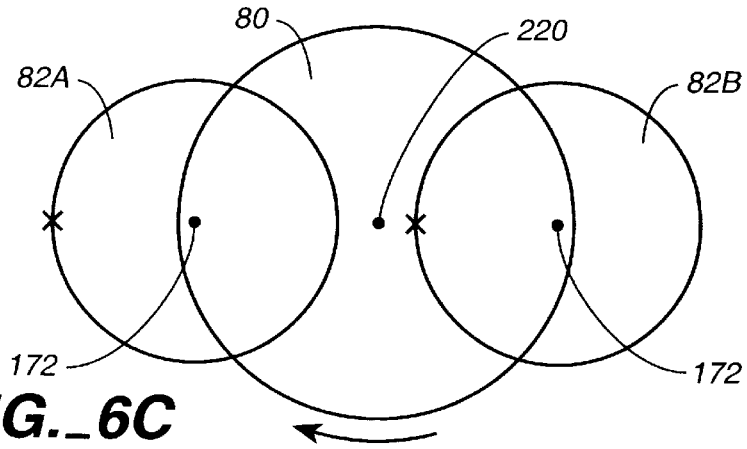

When the carrier head assembly 80 rotates about the axis 220, the outer gears 162 and associated shafts 168 are caused to rotate about their own axes 172 as well. The result is that as the assembly 80 rotates about its axis 130, the carrier heads 82, each of which can hold a substrate to be polished, rotate about the respective axes 172. Preferably, the outer gears 162 have approximately the same number of teeth as the central gear 158. Therefore, each point on a substrate that is held by one of the carrier heads 82 can be caused to translate linearly in a circular path substantially without rotating with respect to the fixed polishing sheet 46. FIGS. 6A, 6B and 6C illustrate several positions of the carrier heads 82 to show how they move in a circular path as the assembly 80 is rotated about the axis 220. In FIGS. 6A, 6B and 6C, the carrier heads are labelled 82A and 82B, respectively, and an "x" provides a reference point on each of the carrier heads 82A, 82B.

A fluid coupling 174 in the form of a collar is positioned around the stationary shaft 78. One or more channels, such as tubes 176, are connected from the fluid coupling 174 to a rotary coupling inside each hollow shaft 168. During operation of the CMP apparatus 20, a fluid such as air is provided from a pneumatic or other source (not shown) and flows down the stationary shaft 78, through the channels 176 via the fluid coupling 174, and through the hollow shafts 168. The fluid is provided to the carrier heads 82 so that the substrates 10 are pressed into contact with the abrasive sheet 46. A vacuum can be provided through the channels 176 to dechuck the substrates 10. When the carrier head assembly 80 is rotated about the axis 220, the fluid coupling 174 rotates about the shaft 78.

The computer 124 controls valves 178 (FIG. 7) to control the amount of air pressure to the carrier heads 82 during polishing. The air-flow through the channels 176 to each of the carrier heads 82 in the assembly 80 can be controlled independently. As a result, the amount of pressure applied to each substrate during polishing can be controlled independently.

As previously mentioned, the station 25 can employ optical or other techniques for end-point or thickness monitoring to determine when polishing should be stopped with respect to a particular substrate 10. In some cases, the end-point detection may indicate that polishing of a substrate held by one of the carrier heads 82 should be stopped, even though polishing is not yet completed with respect to a substrate held by the second carrier head. In such a situation, the substrate for which polishing is completed can be lifted out of contact with the abrasive sheet 46 by providing a vacuum to dechuck the carrier head 82 holding the substrate. At substantially the same time as the substrate is lifted out of contact with the abrasive sheet 46, the computer 124 turns off the flow of air through the corresponding channel 138 in the shaft 96 to prevent the abrasive sheet 46 from being blown off the plate 94. Although one substrate has been lifted out of contact with the abrasive sheet 46, polishing of the substrate held by the second carrier head 82 can continue.

In operation, the exposed portion of the polishing sheet 46 is vacuum-chucked to the platen 90 by applying a vacuum to the passage 102 (FIG. 4B). Substrates 10 held by the carrier heads 82 are lowered into contact with the polishing sheet 46 by the carrier head assembly 80 (see FIG. 5B). The substrates 10 are positioned above the fluid bearing surface of the plate 94, in other words, above the circular areas 134, 136 with the holes 132. As previously discussed, the computer 124 controls the motors 146, 154 which respectively cause the fluid bearing plate 94 and the carrier head assembly 80 to rotate. The computer 124 controls the speed of the motors 146, 154 so that both the plate 94 and the carrier head assembly 80 rotate in the same direction and at substantially the same speed. In other words, the fluid bearing rotates at the same speed and in angular alignment with the carrier heads 82 while the substrates 10 are held in contact with the abrasive sheet 46. Therefore, the substrates 10 remain positioned directly above the fluid bearing surface of the plate 94 during polishing. The web-type abrasive polishing sheet 46 remains in a fixed position during the polishing operation. A sub-pad 126 can be placed between the plate 94 and the underside of the polishing sheet 46 to modify the effective compressibility of the support for the polishing sheet. In that case, the sub-pad 126 will be stationary with respect to the polishing sheet 46.

After polishing, the substrates 10 are lifted off the polishing sheet 46 by the carrier heads 82, and the vacuum on the passage 98 is removed. The polishing sheet 46 can be advanced to expose a fresh section of the sheet. The polishing sheet 46 is vacuum-chucked to the platen 90 and, after rotating the carousel 60, new substrates are lowered into contact with the polishing sheet. Thus, between each polishing operation, the polishing sheet 46 can be advanced incrementally. The polishing sheet may also be washed between polishing operations. An exemplary mechanism for advancing the polishing sheet 46 is described in co-pending U.S. application Ser. No. 09/244,456, filed Feb. 4, 1999 and assigned to the assignee of the present invention. That application is incorporated herein by reference.

In some implementations, the platen 90 that holds down the abrasive sheet 46 during polishing also can be oscillated back and forth slightly during polishing. The oscillation can help prevent the same area(s) of the sheet 46 from being used during the polishing process and can provide a relatively smooth transition of abrasive material when the sheet 46 is moved forward incrementally between polishing steps. For example, as shown in FIG. 3, the platen 90 is supported by a set of linear bearings 210 and allows the platen to move back and forth as indicated by the arrow 212. In one implementation, the range of the oscillation is several inches. Except for the small amount of oscillation, the polishing sheet 46 remains substantially fixed.

Several advantages can be obtained through the polishing station 25 using a web-type abrasive polishing sheet 46. Web-type abrasive sheets are thin and incompressible relative to other polishing pad materials. Such abrasive sheets have a low bending stiffness because they are thin. Therefore, it is possible to use the webtype abrasive sheet 46 either alone or in conjunction with a sub-pad 126 to achieve a desired stiffness and compressibility. In particular, a web-type of abrasive sheet and a sub-pad can be selected to modify the overall bending modulus and compressibility and, therefore, provide improved compliance with the surface of the substrate 10. The sub-pad 126 can, thus, be used to optimize local and global polishing uniformity across the substrate 10.

Although the web-type abrasive sheet 46 can provide a desirable low bending stiffness, such a polishing sheet does not generally provide a particularly good material against which to press a solid, mechanical, moveable bearing surface. On the other hand, the rotatable plate 90, which serves as a fluid bearing, can provide a substantially uniform bearing force against the downward pressure of the carrier heads 82. Therefore, the fluid bearing is particularly suited for use with the thin web-type of abrasive sheet 46.

Furthermore, use of the fluid bearing makes possible a wide selection of materials as the web-type abrasive sheet 46 and/or the sub-pad 126 because the fluid bearing is less likely to damage the material it is supporting. Therefore, the optimum bending stiffness and compressibility required to achieve a highly uniform polish for the finished substrates 10 can be selected with less concern for the durability or other mechanical properties of the fixed abrasive sheet 46 or the sub-pad 126.

Figure 8:
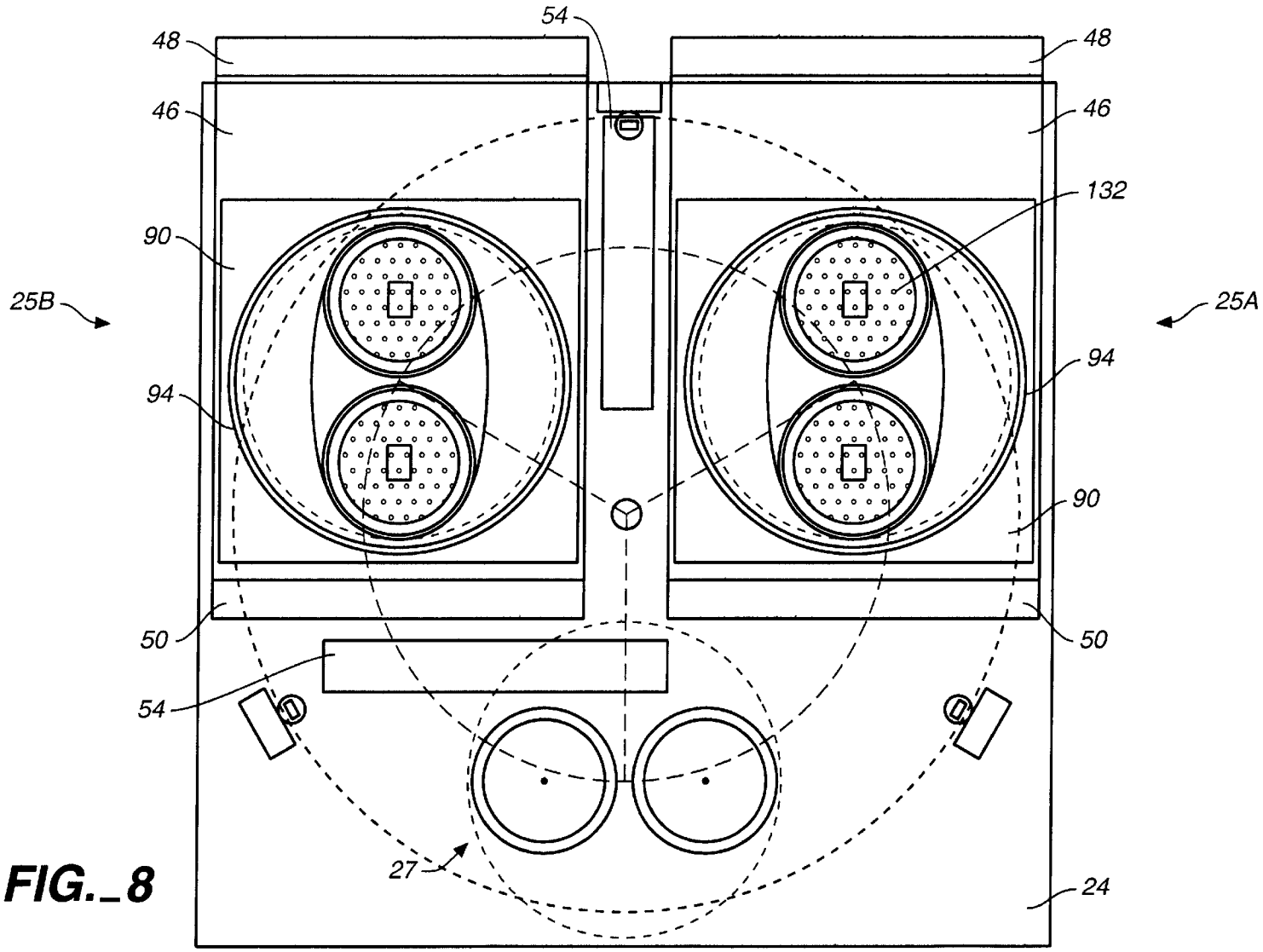
FIG. 8 is a plan view of the table top of a CMP apparatus according to another embodiment of the invention.

Although the CMP apparatus depicted in the FIGS. 1 and 2 show three stations 25, 26, 27, and three carrier head assemblies 80, additional stations and a corresponding number of carrier head assemblies can be added. Each of the stations can be separated from adjacent stations by substantially equal angular intervals. Similarly, the carrier head assemblies would be separated from one another by the same angular intervals. Furthermore, although the illustrated embodiment of FIG. 1 shows a polishing station 25 and a buffing station 26, two polishing stations, 25A, 25B, each of which is substantially similar to the polishing station 25, can be provided instead (see FIG. 8). Additionally, although in many implementations it is desirable to use an abrasive sheet as the polishing sheet 46, in other implementations the sheet 46 can be a soft polishing sheet that is used to buff the substrate. Alternatively, a polishing or buffing material in roll form can be provided for one or both of the stations 25, 26.

In some implementations, additional carrier heads 82 can be provided on each assembly 80 so that more than two substrates 10 can be processed by each assembly at the same time. Additional pairs of gears 160, 162 would be provided for each additional carrier head 82. Similarly, an additional circular pattern of holes 132 would be provided in the plate 94 for each additional substrate that can be held by the carrier head assembly 80.

Other implementations are within the scope of the claims.

What is claimed is:

1. A chemical mechanical polishing apparatus comprising:

a polishing sheet that is substantially fixed during polishing; and a rotatable plate disposed below an exposed portion of the polishing sheet, wherein an upper surface of the plate is positioned near a lower surface of the polishing sheet, and wherein the plate includes a pattern of holes in its upper surface through which a fluid can flow to provide an upward pressure against the lower surface of the polishing sheet.

2. The apparatus of claim 1 wherein the polishing sheet comprises a thin coated, micro-replicated, abrasive polishing pad.

3. The apparatus of claim 2 wherein the polishing pad has relatively high bulk compressibility and low bending stiffness.

4. The apparatus of claim 1 further including:

a source to provide fluid to the holes in the rotatable plate; and a computer-controlled valve for controlling the flow of fluid from the source to the pattern of holes in the rotatable plate.

5. The apparatus of claim 1 wherein the pattern of holes in the upper surface of the rotatable plate includes an area whose size corresponds to a substrate to be polished by the polishing sheet.

6. The apparatus of claim 1 wherein the pattern of holes in the upper surface of the rotatable plate includes an area whose size corresponds to a substrate to be polished by the polishing sheet plus an area covered by a substrate retaining ring.

7. The apparatus of claim 1 wherein the pattern of holes in the upper surface of the rotatable plate includes a plurality of areas of vertical holes, wherein each area has a size that corresponds to a substrate to be polished by the polishing sheet.

8. The apparatus of claim 7 wherein the flow of fluid to each of the plurality of areas of holes can be controlled independently.

9. The apparatus of claim 1 further including:

a motor coupled to the rotatable plate for causing the plate to rotate during polishing of a substrate.

10. The apparatus of claim 9 wherein the polishing sheet has one end wrapped around a feed roller and another end wrapped around a take-up roller.

11. A chemical mechanical polishing apparatus comprising:

a carrier head assembly including a plurality of carrier heads each of which can hold a substrate;

a shaft about which the carrier head assembly can be rotated; and a motor-driven pulley system for causing the carrier head assembly to rotate about the shaft, wherein each of the carrier heads moves in a circular path substantially without rotating with respect to a fixed point as the carrier head assembly is rotated about the shaft.

12. The apparatus of claim 11 further including:

a system of gears coupled to the carrier heads for causing each of the carrier heads to move in a circular path substantially without rotating with respect to a fixed point as the carrier head assembly is rotated about the shaft.

13. The apparatus of claim 12 wherein the system of gears includes a central gear surrounding the shaft, a plurality of idler gears coupled to the central gear and a plurality of outer gears each of which is coupled to one of the idler gears and a respective one of the carrier heads.

14. The apparatus of claim 11 further including a rotatable fluid coupling positioned about the shaft and a plurality of channels having one end coupled to the fluid coupling and a second end rotarily coupled to a respective one of the carrier heads to allow a fluid to flow to provide a downward pressure on a substrate held by the carrier heads.

15. The apparatus of claim 14 wherein the downward pressure on a substrate held by each carrier head can be controlled independently.

16. The apparatus of claim 14 wherein polishing of a substrate held by a first one of the carrier heads can be stopped while polishing of a substrate held by a second one of the carrier heads is continued.

17. A chemical mechanical polishing apparatus comprising:

a polishing station including:

(a) a polishing sheet that is substantially fixed during polishing; and (b) a rotatable plate disposed below an exposed portion of the polishing sheet such that an upper surface of the plate is positioned near a lower surface of the polishing sheet, and wherein the plate includes a plurality of areas of holes in its upper surface through which a fluid can flow to provide an upward pressure against the lower surface of the polishing sheet, wherein each area of holes has a size that corresponds to a substrate to be polished by the polishing sheet; and a rotatable carrier head assembly including a plurality of carrier heads each of which can hold a substrate, wherein the carrier head assembly can be positioned to bring the substrates into contact with an upper surface of the polishing sheet;

wherein the rotatable plate and the carrier head assembly are rotated at substantially the same speed and in angular alignment when the substrates are held in contact with the polishing sheet so that the substrates remain positioned directly above the areas of holes in the plate during polishing.

18. A chemical mechanical polishing apparatus comprising:

a rotatable carousel; and a plurality of carrier head assemblies coupled to the carousel, wherein each carrier head assembly includes:

(a) a plurality of carrier heads each of which can hold a substrate; and (b) a motor-driven system for causing the carrier head assembly to rotate about its center axis, wherein each of the carrier heads moves in a circular path substantially without rotating with respect to a fixed point as the carrier head assembly is rotated about its center axis.

19. The apparatus of claim 18 further including:

a plurality of substrate processing stations, wherein the carousel can be rotated to move each carrier head assembly from one station to another station.

20. The apparatus of claim 19 wherein the processing stations are separated from one another in substantially equal angular intervals and wherein the carrier head assemblies can be positioned in angular alignment with the stations.

21. A method of polishing at least one substrate held by a carrier head assembly, the method including:

positioning the carrier head assembly so that each substrate is in angular alignment with a fluid bearing disposed below a substantially fixed polishing sheet;

positioning the carrier head assembly to bring the at least one substrate into contact with the polishing sheet; and rotating the carrier head assembly and the fluid bearing at substantially the same speed and in angular alignment while the at least one substrate is held in contact with the polishing sheet to polish the at least one substrate.

22. The method of claim 21 wherein the carrier head assembly holds a plurality of substrates, the method further including:

independently controlling, during polishing, a downward pressure with which each substrate is pressed against the polishing sheet.

23. The method of claim 21 wherein the carrier head assembly holds a plurality of substrates, the method further including:

lifting a first one of the substrates out of contact with the polishing sheet while a second one of the substrates continues to be polished by the polishing sheet.

24. The method of claim 21 wherein the carrier head assembly holds a plurality of substrates, the method further including:

providing an upward pressure to counteract a downward pressure exerted on the substrates, wherein the amount of upward pressure is controlled independently for each of the substrates.

25. The method of claim 21 wherein the carrier head assembly holds a plurality of substrates, the method further including:

moving the substrates in a circular path substantially without rotating with respect to the polishing sheet as they are polished by the polishing sheet.

* * * * *